US008210671B2

(12) United States Patent
Mattern et al.

(10) Patent No.: US 8,210,671 B2
(45) Date of Patent: Jul. 3, 2012

(54) INK LOADER WITH ACCESS SYNCHRONIZATION

(75) Inventors: Frederick T. Mattern, Portland, OR (US); Brent Rodney Jones, Sherwood, OR (US); Richard G. Chambers, Portland, OR (US); Martin Scott Walsh, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 187 days.

(21) Appl. No.: 12/848,258

(22) Filed: Aug. 2, 2010

(65) Prior Publication Data

US 2012/0026218 A1 Feb. 2, 2012

(51) Int. Cl.
*B41J 2/175* (2006.01)

(52) U.S. Cl. ..... 347/88

(58) Field of Classification Search ..... 347/5, 6, 347/88, 99

See application file for complete search history.

(56) References Cited

U.S. PATENT DOCUMENTS

| | | | | |
|---|---|---|---|---|
| 5,861,903 | A | 1/1999 | Crawford et al. | |
| 7,425,061 | B2 | 9/2008 | Korn et al. | |
| 7,591,550 | B2 * | 9/2009 | Buehler et al. | 347/99 |
| 7,726,798 | B2 | 6/2010 | Mattern et al. | |
| 8,132,877 | B2 * | 3/2012 | Gold et al. | 347/7 |

* cited by examiner

*Primary Examiner* — An Do

(74) *Attorney, Agent, or Firm* — Maginot, Moore & Beck, LLP

(57) ABSTRACT

An ink loader for a phase change ink imaging device includes an automated access control system that enables ink stick insertion based on user initiated ink load requests with reference to the operating state of the imaging device.

20 Claims, 7 Drawing Sheets

INK LOADER WITH ACCESS SYNCHRONIZATION

TECHNICAL FIELD

This disclosure relates generally to phase change ink printers, and in particular to solid ink loaders for use in such printers.

BACKGROUND

Phase change ink imaging products encompass a wide variety of imaging devices, such as ink jet printers, facsimile machines, copiers, and the like, that are configured to utilize phase change ink to form images on recording media. Some of these devices use phase change ink in a solid form, referred to as solid ink sticks. Imaging devices that utilize solid ink sticks are typically provided with an ink loader having feed channels for receiving the solid ink sticks. The ink sticks are inserted into a feed channel through an insertion opening located near one end, or insertion end, of the channel and urged by a spring-loaded push block toward a melting device located at the other end, or melt end, of the channel that melts the ink to a liquid suitable for jetting onto print media. When multiple ink sticks are inserted into the channel, the ink sticks abut against each other in the channel to form a column of ink that extends from the ink melting device toward the insertion area.

In some devices, a manually operated access cover controls access to the insertion openings of the ink loader for ink stick insertion. The access cover is positioned over the insertion openings and linked to the push blocks in a manner that enables the manual operation of the access cover to be used to control the position of the push blocks in the feed channels. For example, when the access cover is opened, a link retracts the push blocks toward the insertion end to provide clearance for ink sticks to be inserted through the insertion openings into the corresponding feed channels in front of the push blocks. When the access cover is closed, the link returns the push blocks to operable positions in the feed channels for urging ink sticks toward the melting devices at the melt ends of the channels.

While effective, using a manually operated access cover and linkage assembly to enable ink stick insertion into the feed channels requires that the access cover be located at a position that provides sufficient clearance for the cover to be moved through its full range of required motion. Providing this clearance is an issue in some imaging device configurations. In addition, because the access cover is manually operated, manipulation of the access cover by an operator may occur at inappropriate times during printer operation, such as during an ink melt cycle when ink stick feed toward the melt device is required.

SUMMARY

In accordance with the present disclosure, a solid ink loading system for a phase change ink imaging device is provided that includes an automated access control system for enabling ink stick insertion based on user initiated ink load requests with reference to the operating state of the imaging device. In one particular embodiment, a solid ink loading system for a phase change ink imaging device includes at least one feed channel having an insertion opening through which ink sticks are inserted into the feed channel, and an access structure that provides access to the insertion opening. A push block is movably supported in the feed channel for translational movement between the first end and the second end of the feed channel. The push block is driven by an actuator via a drive member. The actuator is configured to actuate the drive member to move the push block toward the first end of the feed channel to at least one retracted position in response to a first signal, and to actuate the drive member to move the push block to an urging position for applying an urging force to ink sticks in the feed channel in the feed direction in response to a second signal. The system includes a load request signal generator configured to generate a load request signal. A controller is operatively connected to the actuator and the load request signal generator that is configured to determine an operating state of the imaging device in response to the load request signal and to generate the first signal selectively with reference to the operating state.

DETAILED DESCRIPTION

Figure 1:
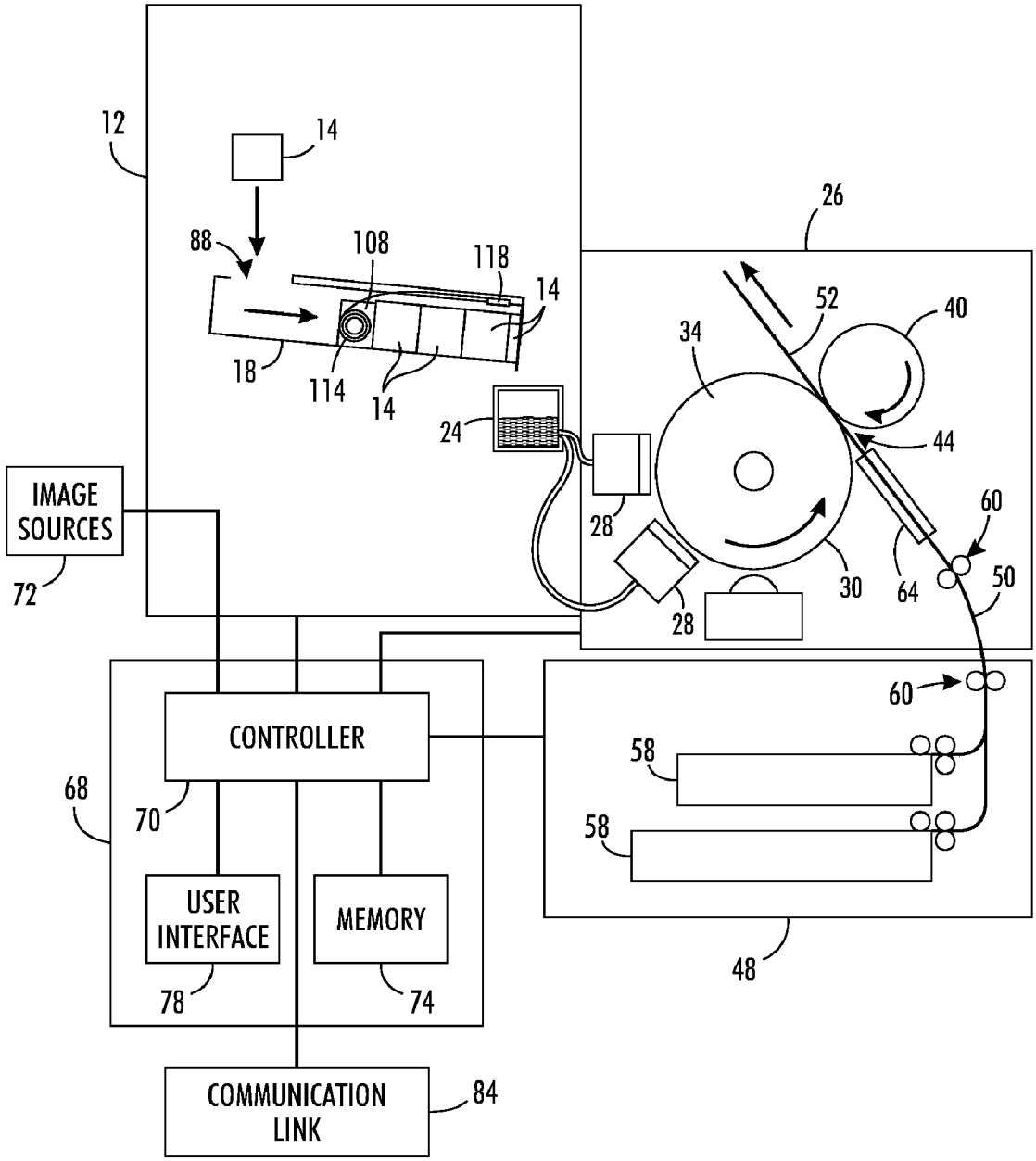
FIG. 1 is a schematic view of a phase change ink imaging device.

For a general understanding of the present embodiments, reference is made to the drawings. In the drawings, like reference numerals have been used throughout to designate like elements.

FIG. 1 is a side schematic view of an exemplary embodiment of a phase change ink imaging device 10 configured for indirect or offset printing using melted phase change ink. The device 10 of FIG. 1 includes an ink handling system 12, also referred to as an ink loader, that is configured to receive phase change ink in its solid form as blocks of ink 14, referred to as solid ink sticks. The ink loader 12 includes feed channels 18 into which ink sticks 14 are inserted. Although a single feed channel 18 is visible in FIG. 1, the ink loader 12 includes a separate feed channel for each color or shade of ink stick 14 used in the device 10. The feed channel 18 guides ink sticks 14 toward a melting assembly 20 at one end of the channel 18 where the sticks are heated to a phase change ink melting temperature to melt the solid ink to form a molten liquid ink, also referred to as melted ink. Any suitable melting temperature may be used depending on the phase change ink formulation. In one embodiment, the phase change ink melting temperature is approximately 100° C. to 140° C. The melted ink is received in a reservoir 24 configured to maintain a quantity of the melted ink in molten form for delivery to printing system 26 of the device 10.

The printing system 26 includes at least one printhead 28 having inkjets arranged to eject drops of melted ink onto an intermediate surface 30. A single printhead is shown in FIG. 1 although any suitable number of printheads 28 may be used. The intermediate surface 30 comprises a layer or film of release agent applied to a rotating member 34 by the release agent application assembly 38. The rotating member 34 is shown as a drum in FIG. 1 although in alternative embodiments the rotating member 34 may comprise a rotating belt, band, roller or other similar type of structure. A nip roller 40 is loaded against the intermediate surface 30 on rotating member 34 to form a nip 44 through which sheets of recording media 52 are fed in timed registration with the ink drops deposited onto the intermediate surface 30 by the inkjets of the printhead 28. Pressure (and in some cases heat) is generated in the nip 44 that, in conjunction with the release agent that forms the intermediate surface 30, facilitates the transfer of the ink drops from the surface 30 to the recording media 52 while substantially preventing the ink from adhering to the rotating member 34.

The imaging device 10 includes a media supply and handling system 48 that is configured to transport recording media along a media path 50 defined in the device 10 that guides media through the nip 44, where the ink is transferred from the intermediate surface 30 to the recording media 52. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

Media conditioning devices may be positioned along the media path 50 for controlling and regulating the temperature of the recording media so that the media arrives at the nip 44 at a suitable temperature to receive the ink from the intermediate surface 30. For example, in the embodiment of FIG. 1, a preheating assembly 64 is provided along the media path 50 for bringing the recording media to an initial predetermined temperature prior to reaching the nip 44. The preheating assembly 64 may rely on contact, radiant, conductive, or convective heat to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures.

Operation and control of the various subsystems, components and functions of the imaging device 10 are performed with the aid of a control system 68. The control system 68 is operably coupled to receive and manage image data from one or more image sources 72, such as a scanner system or a work station connection, and to generate control signal that are delivered to the components and subsystems based on the image data which causes the components and systems to perform the various procedures and operations for the imaging device 10. The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or microcontroller, configured to execute instructions stored in the memory 74. Any suitable type of memory or electronic storage may be used. For example, the memory 74 may be a non-volatile memory, such as read only memory (ROM), or a programmable non-volatile memory, such as EEPROM or flash memory.

Figure 3:
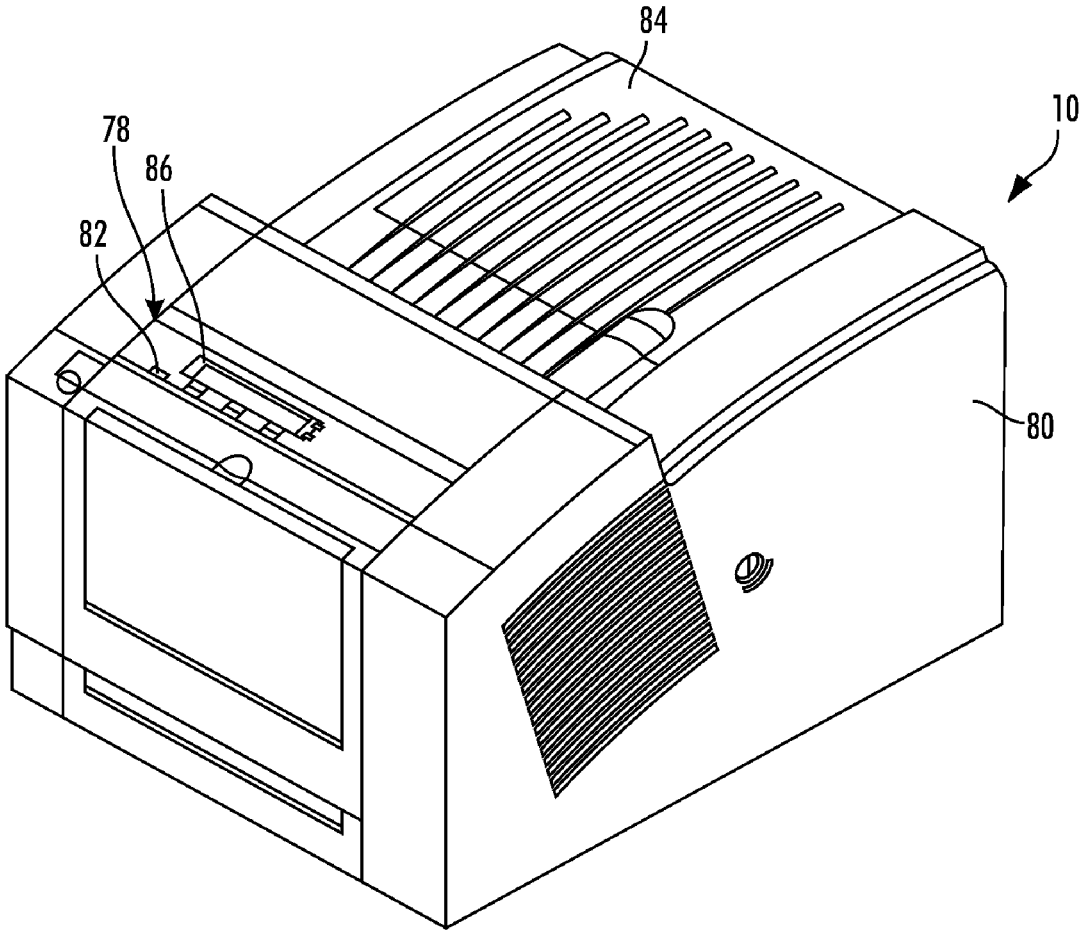
FIG. 3 is a perspective view of an exemplary embodiment of a phase change ink imaging device in accordance with FIG. 1 having an access cover that provides access to the ink loader that receives solid ink sticks, such as the ink stick of FIG. 2.

User interface (UI) 78 comprises a suitable input/output device located on the imaging device 10 that enables operator interaction with the control system 68. For example, UI 78 may include a keypad, buttons, or other similar types of manual actuators 82, and a display 86 (FIG. 3). The controller 70 is operably coupled to user interface 78 to receive signals indicative of selections and other information input to the user interface 78 by a user or operator of the device. Controller 70 is operably coupled to the user interface 78 to display information to a user or operator including selectable options, machine status, consumable status, and the like. The controller 70 may also be coupled to a communication link 84, such as a computer network, for receiving image data and user interaction data from remote locations.

The controller 70 is operably coupled to the various systems and components of the device 10, such as the ink handling system 12, printing system 26, media handing system 48, release agent application assembly 38, media conditioning devices 50, and other devices and mechanisms 80 of the imaging device 10, and is configured to generate control signals that are output to these systems and devices in accordance with the print data and instructions stored in memory 74. The control signals, for example, control the operating speeds, power levels, timing, actuation, and other parameters, of the system components to cause the imaging device 10 to operate in various states, modes, or levels of operation, referred to collectively herein as operating modes.

Figure 2:
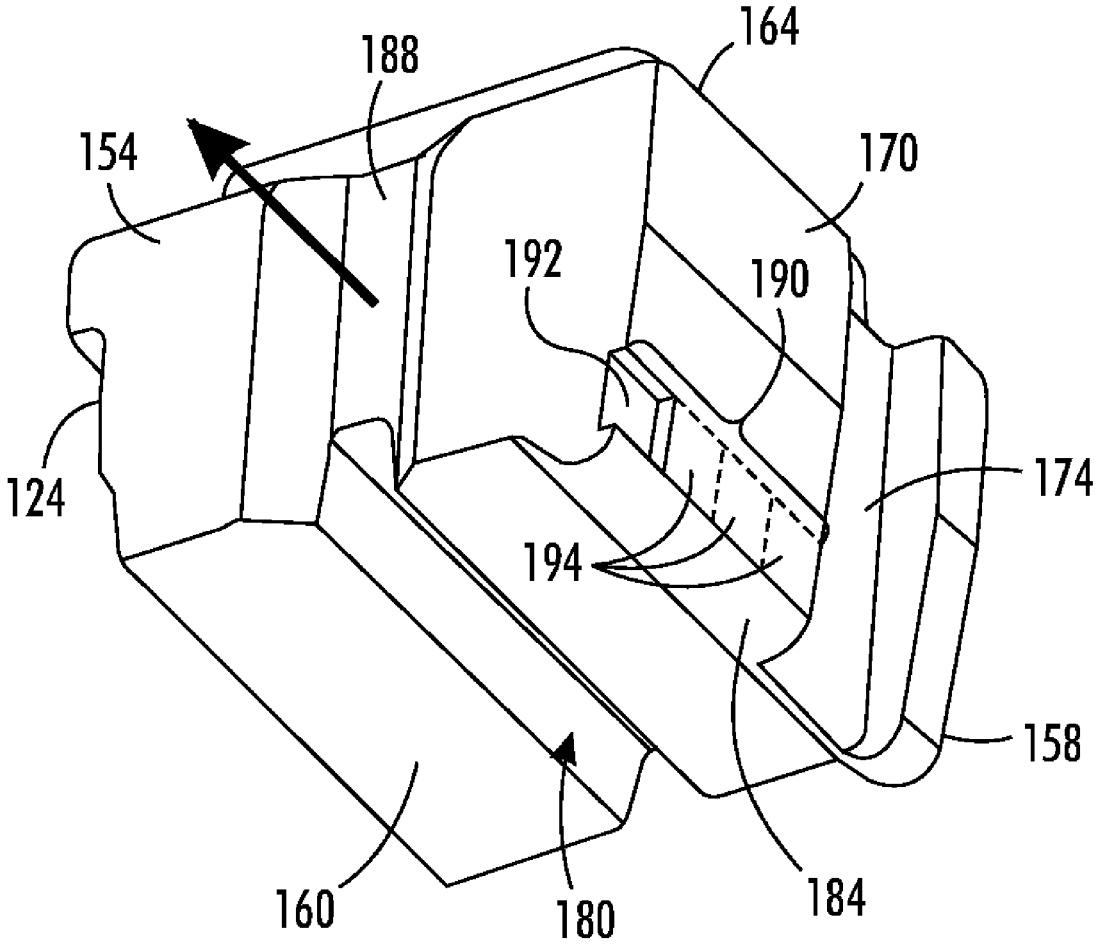
FIG. 2 is a perspective view of a solid ink stick for use with a phase change ink imaging device, such as the device of FIG. 1.

As depicted in FIG. 2, a solid ink stick 14 comprises a body formed of a solidified phase change ink material and shaped using a suitable fabrication process, such as casting, pour molding, injection molding, compression molding, or other known techniques. The body of the ink stick 14 of FIG. 2 includes end surfaces 154, 158, and lateral surfaces 158, 160, 164, 168. The lateral surfaces 158, 160, 164, 168 of the ink stick 14 are configured for arrangement generally parallel to the direction of ink stick travel in a feed channel, referred to herein as the feed direction F. The lateral surfaces include a bottom surface 160 configured for arrangement adjacent to the base or floor of a feed channel 18, a top surface 164 opposite the bottom surface, and a pair of side surfaces 168, 170 that extend between the top and bottom surfaces 164, 160. The end surfaces 154, 158 are configured for arrangement generally perpendicular to the feed direction F with end surface 154 facing in the feed direction F and serving as the leading end of the ink stick, and end surface 158 facing opposite the feed direction F and serving as the trailing end of the ink stick.

Ink sticks, such as ink stick 14 of FIG. 2, may include a number of surface features that aid in the correct loading, guidance, feed control and support of the ink stick when used. As used herein, the term "surface features" and "features" used in relation to and ink sticks refers to topological contours, such as protrusions, recesses, grooves, and the like, that are sized, shaped, and/or otherwise configured to interact in some manner with one or more elements, devices, and members of an ink loader, or feed channel, such as key elements, guides, supports, sensors, etc. For example, the ink stick 14 includes insertion key feature 174 that comprises a groove or notch formed in side surface 170 extending generally between the top surface 164 and the bottom surface 160. The insertion opening 88 in the ink loader for the ink stick 14 is provided with a perimeter (FIG. 4) shaped complementarily with respect to the perimeter shape of the ink stick 14.

The ink stick 14 includes feed control and guidance features for interacting with various structures provided in the feed channel. In one embodiment, ink stick 14 includes a feed key groove 180 formed in the bottom surface 160 extending from the leading end surface 154 to the trailing end surface 158. The feed key groove 180 is configured to straddle a feed key (not shown) that extends from the feed channel. In alternative embodiments, the ink stick 14 may be provided with any suitable type of feed key feature for interacting in any manner with whatever type of keying, guidance or support members are provided in a feed channel. In addition, the ink stick 14 includes guide feature 184 near the ink stick side surface 170 for interacting with a complementary structure in the feed channel to facilitate alignment of ink sticks in the channel and to limit contact between ink sticks and the feed channel structural elements, such as ribs, supports and other potentially restrictive surfaces.

The ink stick 14 also includes nesting features 188 at the leading end 154 of the ink stick. Although not visible in FIG. 2, the ink stick 14 includes a nesting feature in the trailing end surface 158 that is shaped complementary to the nesting feature 140 in the leading end 154. The nesting features enable adjacent ink sticks in the feed channel to interlock to further promote alignment of ink sticks as well as to maximize load density in the feed channel. In use, when an ink stick having a nesting feature 188 in the leading surface 154 abuts an ink stick in the feed channel having complementary nesting feature in the trailing surface 158, the protruding nesting feature of one ink stick is received in the recessed nesting feature of the subsequent stick. The nesting features of the adjacent sticks cooperate to limit lateral movement of the sticks with respect to each other thereby promoting alignment of the sticks in the channel.

In addition to or as an alternative to the insertion, feed guidance, and nesting features, ink sticks may be provided with sensor features for conveying ink stick data to the print controller of the solid ink printer. The ink stick data encoded onto an ink stick may include identification information, such as color, formulation, and intended printer model, as well as printing information, such as printer settings or preferences for use with the ink stick. Sensor features comprise surface formations on the ink stick body that are configured to interact with sensors positioned at one or more locations in the insertion region and/or other portions of feed channels to convey ink stick data to the print controller of a solid ink printer.

Sensor features may have any suitable configuration that permits reliable sensor interaction, such as protrusions, recesses, reflective features, non-reflective features, and the like, depending on the type of sensor used. In the embodiment of FIG. 2, the ink stick 14 includes a sensor feature 190 that comprises one or more contiguous insets 192 arrayed in the feed direction F in a lower portion of the side surface 170. A single inset 192 is shown in FIG. 2. The locations 194 shown as dotted lines represent other positions where insets may be placed in the exemplary embodiment.

Ink stick data may be encoded into a sensor feature 190 of an ink stick by assigning data to the sensor feature 190. To extract the data from the sensor feature 148, the feed channel 18 is provided with a sensor system 194 (FIG. 7) capable of sensing, detecting, or being actuated by the recesses 192 of the sensor feature 190. The sensor feature 190 actuates the sensors of the sensor system 194 causing the sensor system to output signals to the printer controller 70 indicative of the data assigned to the sensor feature 190. The controller 70 may then use the data to influence operations of the printer. For example, in one embodiment, once the ink stick data has been identified, the controller 70 may determine whether or not the ink stick is compatible with the printer and enable or disable operations accordingly.

FIG. 3 shows a perspective view of an exemplary embodiment of a phase change ink imaging device in accordance with FIG. 1. As depicted, the device 10 of FIG. 3 includes an outer housing 80 which encloses the ink handling system 12, printing system 26, media handing system 48, release agent application assembly 38, media conditioning devices 50, and other devices and mechanisms 80 of the imaging device 10. Any suitable housing or support structure may be utilized for the housing 80. As seen in FIG. 3, the user interface 78 is provided at a suitable location on the housing and includes a display 86 and a keypad, buttons, or similar type input devices 82.

Figure 4:
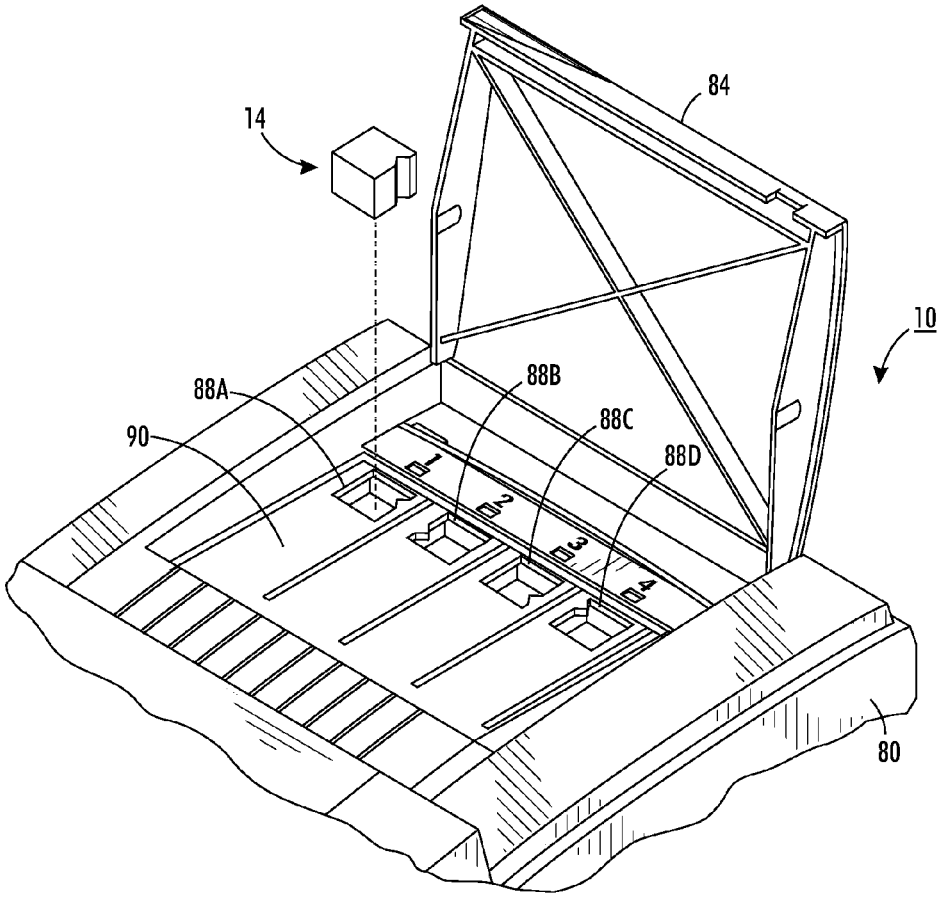
FIG. 4 is an enlarged partial top perspective view of the device of FIG. 3 with the access cover open showing an ink stick, such as the ink stick of FIG. 2, in position to be inserted through an insertion opening and into a feed channel of the ink loader.

To enable ink sticks to be inserted into the feed channels 18 of the ink loader 12, the housing 80 of the device 10 includes an access structure 84, such as a cover, that provides access to the insertion area of the ink loader 12. In the embodiment of FIG. 3, the access structure comprises a hinged access cover 84 that opens, as shown in FIG. 4, to provide the user access to the insertion openings 88 through which ink sticks may be inserted into the appropriate one of the feed channels 18. In alternative embodiments, other access structure types and configurations may be used for providing access to the insertion openings 88, for example, a drawer or sliding cover.

As seen in FIG. 4, opening the access cover 84 reveals insertion openings 88A-D. Each opening 88A-D provides access to an insertion area 98 for the feed channels of the ink loader 12. A color printer typically uses four colors of ink (yellow, cyan, magenta, and black). Ink sticks 14 of each color are inserted through one of openings 88A-D into the appropriate feed channel for that color of ink. As depicted, each opening 88A-D has a perimeter shape associated with a particular configuration of ink stick, as described above, that enables ink sticks of that configuration to be inserted through the opening and into the corresponding feed channel while excluding ink sticks of other configurations from being inserted into the feed channel.

Figure 7:
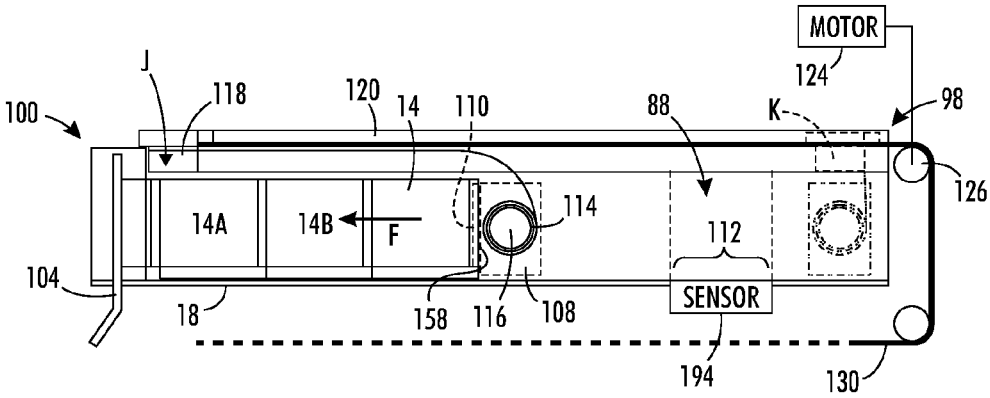
FIG. 7 is a schematic side view of an exemplary embodiment of a feed channel taken along line 5-5 of FIG. 4 showing one embodiment of a power driven yoke positioning system for the access control system of FIG. 5.
Figure 8:
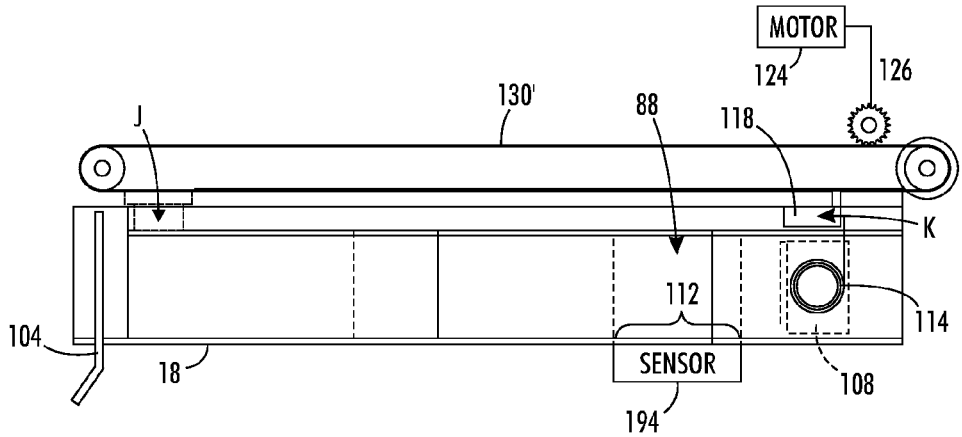
FIG. 8 is a schematic side view of the feed channel of a feed channel taken along line 5-5 of FIG. 4 showing another embodiment of a power driven yoke positioning system for the access control system of FIG. 5.

FIGS. 7 and 8 depict a side view of a feed channel 18. As shown, the feed channel 18 comprises a longitudinal chute or similar type of structure having an insertion area 98 at or near one end of the channel 18 and a melt area 100 at or near the other end of the channel 18. The term longitudinal, as applicable to an ink loader, refers to its lengthwise shape complementary to feed direction rather than widthwise in a direction across feed channels. The chute and its feed channels may be straight, horizontal, vertical, sloped, arcuate or any combination. The insertion opening 88 is located proximate the insertion area 98 to enable ink sticks 14 to be sequentially loaded into the channel 18. Once inserted, the ink sticks 14 are aligned and abutted against each other to form a substantially continuous column of solid ink that extends between the insertion area 98 and the melt area 100 of the channel 18. The column of solid ink is moved in a feed direction F toward the melt area 100 by a mechanized delivery system and/or by gravity until the ink stick 14*a* at the leading end of the column (i.e., the end closest to the melt area) impinges on a melting device 104, such as a heated plate, located in the melt area 100 of the channel. A single ink stick is all that needs to be loaded to enable printer functionality. One of the benefits of a solid in printer is that any number of sticks up to the load capacity may be inserted at any time.

The heated plate 104 heats the impinging portion of the ink stick 14*a* to a melting temperature for the ink which melts the solid ink to a liquid ink suitable for fluid ink transport or jetting by the ink jets of the printhead(s) 28. The melted ink is directed from the heated plate to the melted ink reservoir 24 (FIG. 1) where a quantity of the melted ink is maintained in molten form for delivery to the ink jets of the printhead(s) 28 as needed. The reservoir 24 may be associated with the printhead(s) 28 or be part of an intermediate ink delivery system (not depicted). As the heated plate 104 melts the ink stick 14*a* impinging on the plate, the column of ink sticks continues to be urged toward the heated plate 104 so that the next ink stick 14*b* of the column is moved into impinging contact with the heated plate 104 when the first ink stick 14*a* has been completely melted.

In the embodiment of FIGS. 7 and 8, the feed channel 18 includes a mechanized delivery system comprising a push block 108 that is supported in the feed channel for translational movement between the insertion area 98 and melt area 100. The push block 108 is operatively connected to a drive system that is configured to move the push block between an urging position and at least one retracted position. In the urging position, the push block 108 is moved into contact with the trailing end of the column of ink sticks 14 in the feed channel by the drive system to apply an urging force to the trailing end of the column of ink sticks to urge the ink sticks in the feed direction F so that the leading ink stick of the column impinges on the melt plate 104. The push block 108 continues to apply the urging force to the column of ink as the leading ink stick is melted so that the next ink stick in the column is moved into contact with the melt plate when the leading ink stick is completely melted.

When retracted, the push block is moved toward the insertion end 98 of the feed channel to a point past the insertion region 112 of the channel (i.e., the location in the feed channel where inserted ink sticks 14 come to rest in the feed channel) to enable ink sticks to be inserted into the feed channel in front of the push block (relative to the feed direction F). In embodiments, the surface 110 of the push block 208 that faces in the feed direction F may be contoured complementary to the trailing end of the ink sticks with which it is intended to be used to enable the push block to nest with the trailing ink stick of the column of ink in the feed channel. Nesting the push block with the trailing ink stick in this manner reduces the ability of the push block and the trailing ink stick to move laterally with respect to each other and promotes reliable feed of the column of ink toward the melt area 138. The push block nesting feature may also be used as an insertion key for the mating side of ink sticks.

In the embodiment of FIGS. 7 and 8, the urging force is provided by a constant force spring 114 which is wound at one end as a freely rotatable coil housed within the push block 108. The coil may be wound about a hub 116. The other end of the spring 114 is attached to a yoke 118. The yoke 118 is configured to move adjacent to the feed channel 18 between a forward position J proximate the melt end 100 of the feed channel 18 and a rearward position K proximate the insertion end 98 of the feed channel. The yoke 118 may be supported for movement between the forward and rearward positions in any suitable manner. For example, in the embodiment of FIGS. 7 and 8, the yoke 118 is configured to cooperate with a guide slot and/or guide rail 120 arranged adjacent to the feed channel 18 to enable translational movement of the yoke 118 between the forward and rearward positions J,K, respectively.

When the yoke 118 is in the forward position J, the constant force spring 114 pulls the push block 108 toward the melt area 138 proximate the yoke 118. If ink sticks are loaded into the feed channel 18 in front of the push block 108, the pulling force of spring 114 on the push block 108 causes the push block 108 to move into contact with the trailing end of the ink sticks in the channel and urge the ink sticks toward the melt end 100 of the channel 18. The spring 114 is coupled to the hub of the push block 108 in a manner that enables the spring body to extend between the yoke 118 and the push block 108 without interfering with ink stick movement in the feed channel. For example, as depicted in FIGS. 7 and 8, the spring body extends along a path that is located above the feed path of ink sticks in the feed channel. In embodiments, the spring 114 may extend along a path to either lateral side of the feed channel or below the feed channel. To move the push block 108 to the retracted position, the yoke 118 is moved from the forward position J to the rearward position K. When the yoke 118 is in its rearward position, the spring 114 coils within the push block thereby allowing the yoke to move the push block reward to its retracted position in the feed channel to enable insertion of ink sticks.

In embodiments, to the extent that the face 110 of the ink push block 108 protrudes into the insertion region 112 when in the retracted position, the push block face 112 may function as a part of the insertion keying to block insertion of incorrect ink sticks. For example, the face 110 of the push block 108 may prevent full insertion of an ink stick 14 unless the ink stick has a length from the leading end to the trailing end of the ink stick 14 that corresponds to the distance between the leading end of the insertion opening 88 (i.e. portion of the perimeter of the insertion opening 88 that extends toward the melt end of the channel) and the face 110 of the push block 108, which may extend into the insertion region sufficiently to act as a keying element. In addition, if the push block face 110 is contoured, as described above, the push block may prevent full insertion of an ink stick into the feed channel if the trailing end of the ink stick does not have a contour that complements the contour of the face of the ink stick push block. Push block insertion keying may be used in addition to, or in lieu of, providing a key shape in the section of the perimeter of the opening 88 that is farthest from the melt plate. In embodiments, the height of the ink stick may be greater than the height of the push block to allow for keying features in the lower portion of the ink stick that are not present in the upper portion of the ink stick.

As mentioned above, in previously known devices, the yoke was linked to the access cover in a manner that allowed manual operation of the access cover to cause the yoke to move between its forward position and rearward position. Thus, ink stick insertion was enabled by simply opening the access cover thereby causing the yoke to move the push block to its retracted position. However, moving the push block fully to the retracted position in this manner required the access cover to be moved through substantially its full range of motion, e.g., fully closed to fully open. Clearance for a full range of motion for such an access cover may not available for some device configurations, particularly an access cover that extends over substantially the full length of the feed channels which is long enough to provide leverage advantage for the user. In addition, because the access cover is manually operated, manipulation of the access cover by an operator may result in the urging force being removed from the column of ink in the feed channel at inappropriate times during printer operation, such as during an ink melt cycle when ink stick feed toward the melt device is required.

To address these issues, the imaging device 10 includes an ink loader access control system 200 (FIG. 5) with powered push block drive member positioning that enables the drive member, or yoke, to be moved between its forward and rearward positions, thus controlling the position of the push block, without requiring manual manipulation of an access cover. A power driven yoke eliminates exposing the user to high forces of the manual access cover system. A power driven yoke also enables an intermediate position for a non melting state in which the push block applies reduced or no force against ink sticks, which results in less heat and pressure induced ink deformation and irregular path melt and flow tendencies which can cause or contribute to ink jams. The yoke or drive member is operatively connected to the push block such that it can push the push block toward a retracted position or pull it through a spring toward the ink load position. As explained below, the powered yoke positioning system is synchronized with device operation so that the push block is retracted for ink insertion only at times during which the removal of the urging force from the ink sticks in the feed channel does not adversely affect device performance.

In addition, because access cover movement is not required to position the yoke, a number of other access structure configurations and movement types are possible. For example, one such configuration is a multi-part drawer style loader that enables ink to be loaded into the withdrawn portion of the loader without having to perform some type of ink stick feed force relief. The yoke can be driven from a forward melt function location to a rearward retracted park position beyond the pull out drawer region. Other examples include a fixed in place ink loader that is located under an extended media path leading to a finisher, e.g., binder, stapler, hole puncher, and the like, or an ink loader of a device having an input feeder and/or scanner, affixed or integrated at the upper surface region of the housing. The use of a powered yoke positioning system enables a small region within the media exit path to be used for ink stick insertion access without requiring the exit path, input feeder, or scanner structure to be lifted to access the loader and cycle the yoke.

Figure 5:
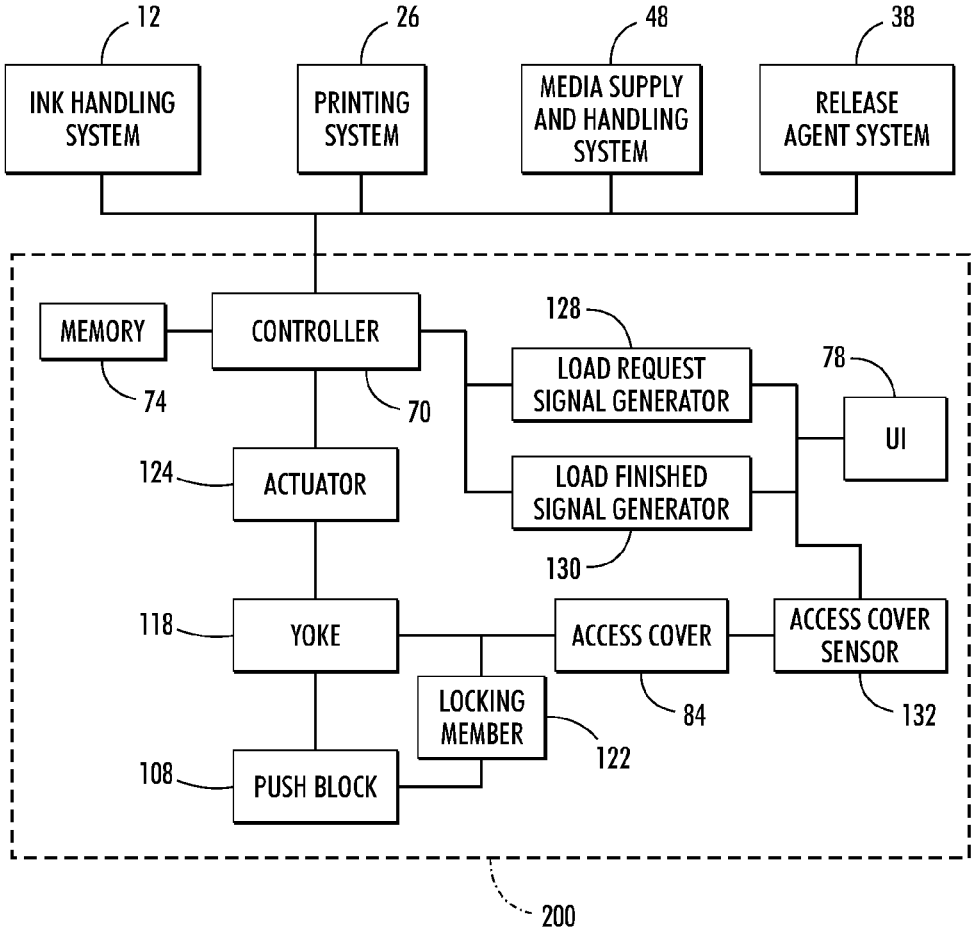
FIG. 5 is a block diagram of the access control system of the imaging device of FIG. 1.

A schematic embodiment of an access control system with powered yoke positioning is shown in FIG. 5. As depicted, the access control system comprises an actuator 124 operatively connected to the yoke 118 for moving the yoke between its forward and rearward positions based on control signals received from controller 70. For example, as depicted in FIGS. 7 and 8, the actuator 124 may be configured to move the yoke 118 from the forward position J to the rearward position K in response to a first signal, e.g., retract signal, received from the controller 70, and to move the yoke from the rearward position K to the forward position J in response to a second signal, e.g., a load signal, received from the controller 70. The retract and load control signals may take any suitable form capable of causing the actuator to move the yoke to the intended position.

The actuator 124 may be implemented in any suitable manner. For example, as depicted in FIG. 7, the actuator 124 may comprise an electric motor connected with or without a gear reduction, to a drive wheel 126 acting on a flexible track confined link member 130 that is coupled to the yoke 118. The thin flexible link 130 is routed along a guide path appropriate to optimal placement of a given printer architecture. To gain access, the flexible link 130 is driven by the actuator 124 so that the flexible link follows a guide path appropriate to optimal placement of a given printer architecture. In one embodiment, the yoke 118 is driven by two such links, one at either side of the loader so that skewing is prevented and firm track confinement is unnecessary. In FIG. 8, the actuator comprises a looped drive belt or link 130' similarly driven by an electric motor but in a continuous loop so that there is no tail end to route. These are example drives, others are possible. Electro-mechanical drive possibilities extend to motion via pneumatics, hydraulics, linear motors, piezo motors and so forth. Other drives are also contemplated, such as a yoke driven by one or more leadscrews that run in place through complementary thread features in the yoke.

Referring again to FIG. 5, in embodiments, driving the yoke under power enables the motion and/or position of the yoke to be used for other purposes, such as access structure control. For example, an access structure 84, such as a cover, panel, and the like, for an ink loader may be configured for movement from an open position in which ink stick insertion through the insertion opening 88 is enabled and a closed position in which ink stick insertion through the insertion opening is disabled. Any suitable access structure 84 configuration may be used for enabling and disabling ink stick insertion through the insertion openings. The access control system 200 may include a suitable locking member 122, device, or system that is configured to control the open and closed positions of the access structure based on the position of the yoke and/or the push block. For example, the locking member 122 may be configured to prevent movement of the access structure from the closed position to the open position when the yoke is not located in its rearward position, or when the push block is not in its retracted position. In embodiments, the yoke position may also be the driver to cause such an access panel or drawer to fully or partially open, whether mechanically driven or by releasing the catch for a spring or weight influenced balance actuation.

In one embodiment, the controller 70 is operatively connected to a load request signal generator 128 that is configured to output a load request signal to the controller 70 in response to user selection or designation of the load request option via the user interface 78. In response to receiving the load request signal, the controller 70 implements a load grant process for determining whether and/when to generate the retract signal for the actuator 124 which results in the push block being moved to the retracted position to enable ink stick insertion. Data and instructions for implementing the load grant process may be stored in the memory 74 for the controller 70 to access. In this case, the push block drive member being in an imaging device operation enabled position may be utilized to lock or constrain the access cover so as not to allow interruption of print operations that might occur due to full or partial opening of the cover.

Figure 6:
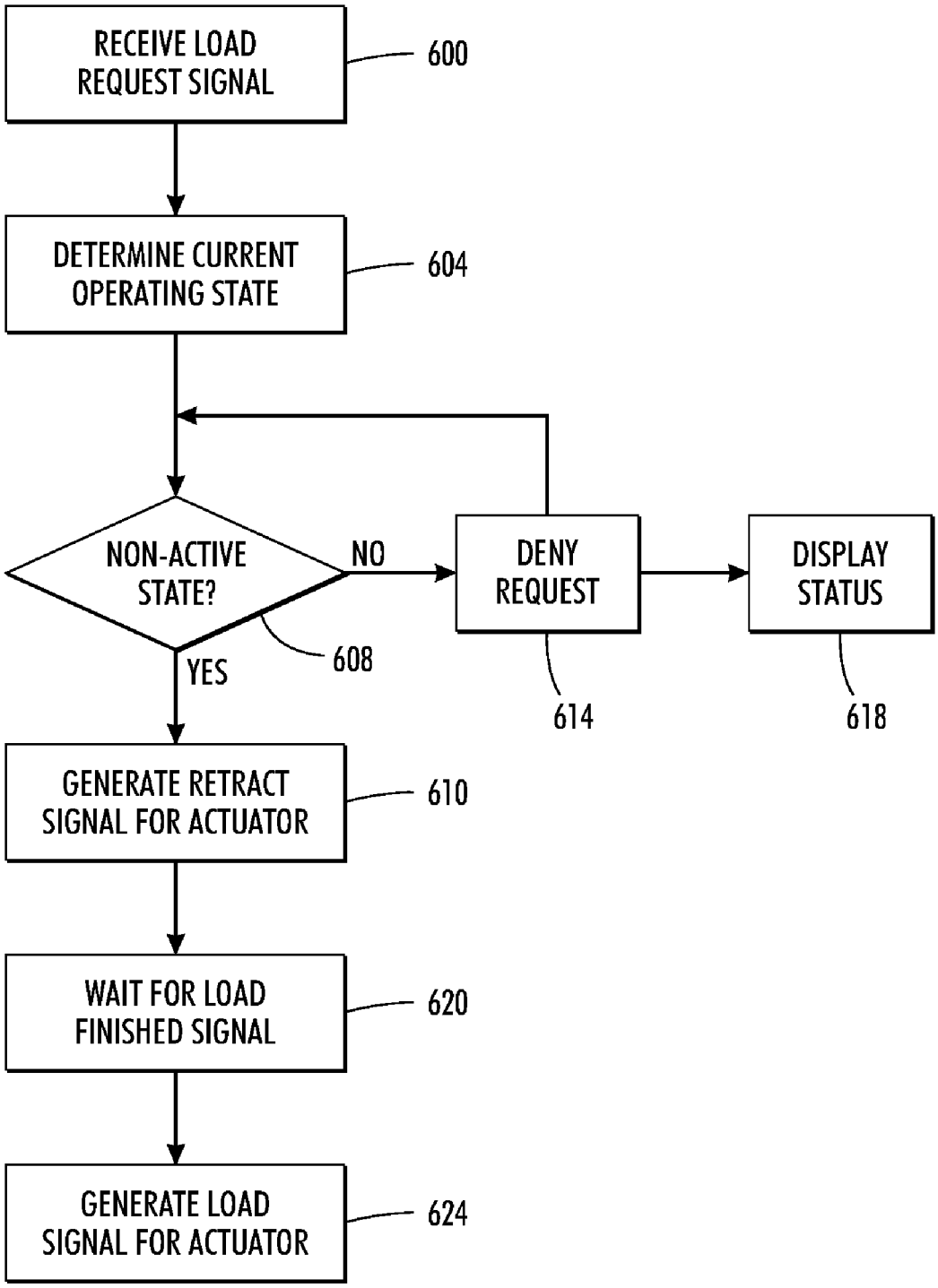
FIG. 6 is a flowchart of an embodiment of a load grant process implemented by the controller of the access control system of FIG. 5.

A flowchart of an embodiment of a load grant process that may be implemented by the controller 70 in response to receiving a load request is depicted in FIG. 6. The process begins with the receipt of the load request signal from the load request signal generator 128 (block 600). As mentioned, the load request may be generated in response to user selections via the user interface of the device and, consequently, such requests may occur at substantially any time during the operation of the device. In embodiments, to aid users of the device in maintaining adequate amounts of solid ink in the feed channels, the controller is configured to communicate ink status data to users via, for example, the user interface. The ink status data may comprise alerts or messages generated when the amount of ink in a feed channel has reached a predetermined level, e.g., ink low, ink out, and the like. In some cases, ink status data may comprise a substantially continuously monitored and/or updated indication of the amount of solid ink in a feed channel which may be presented in any suitable manner, such as a graphical depiction or animation. The amount or number of solid ink sticks in each feed channel may be detected, monitored, and/or determined directly or indirectly by the controller of the device 10 in any suitable manner. The amount of ink in the loader prior to installing additional sticks may influence when the load enable state is established relative to print jobs in process or in the queue. Such consideration may extend to determining ink requirements for a job that may not be able to be completed prior to the addition of more ink, as might be the case with a large print job of heavy graphics.

The controller then determines the current operating state of the imaging device (block 604). The current operating state may be determined in any suitable manner. As mentioned, the controller is operably coupled to the various systems and mechanisms of the device 10, such as the ink handling system 12, printing system 26, media handing system 48, release agent application assembly 38, media conditioning devices 50, and other devices and mechanisms 80 of the imaging device 10 and is configured to send operating instructions to and receive status information from these systems. Based on the status information received from the various systems, the controller 70 is configured to determine the current operating state of the device.

At block 608, a determination is made as to whether the current operating state is a non-active operating state, such as standby, sleep, ready, power-saving, or similar type of state or mode where ink loader access does not present a concern, or an active operating state, such as a print mode in which a print job is being executed, a maintenance mode in which the device is implementing a maintenance routine (e.g., purging and/or wiping the printheads), any state in which a melt cycle is currently being performed, and others. If the current operating state is a non-active state, the controller generates the retract signal for the actuator 124 without a substantial delay (block 610). If the current operating state is an active state, the load request is denied and the retract signal is not generated (block 614) and control returns to block 608. In embodiments, the controller 70 may be configured to output a suitable message, alert, alarm, or other form of communication to the user via the user interface 78 indicating, for example, that the load request cannot be granted at this time (block 618). The controller may be configured to determine, based on the current activities of the device 10, an estimated time remaining until the load request can be granted and to communicate the estimated time to the user as well.

In embodiments, the controller may be configured to delay the granting of a load request until the device 10 has completed its current activity or function before granting the load request. For example, if one or more print jobs are currently being executed by the device, the controller may be configured to wait until the currently executed print job(s) has been completed and the device 10 has returned to a non-active state before granting the load request by generating the retract signal. In some cases, if the device is in an active state when a load request is received, the controller may be configured to determine a suitable time to interrupt the device 10 to transition the device to a non-active state for ink loading and then to return the device 10 to the active state when ink loading has been completed. For example, if the device is printing a multi-page print job, the controller may be configured to wait until the current page of the print job has been completed and then temporarily suspend printing operations to place the device in an inactive state for ink loading. Once ink loading has been finished (explained below), the controller may return device 10 to the active state to resume executing the suspended print job. In some implementations, it may not be advisable to allow loading ink while one or more melt plates are capable of melting ink. Influence to load access timing may extend to whether or not one or more melt plate heaters are on or how long they have been off. There are other considerations that may provide opportunity to more optimally balance machine state and user needs, for example, the number of pages in a print job and page coverage. Another embodiment may provide an overriding interrupt to establish the ink load enable state as soon as is practical by user action, for example, a double press of the load access request.

As depicted in FIG. 5, the controller is also operatively connected to a load finished signal generator 130. In one embodiment, the load finished signal generator is operably connected to an access structure or cover sensor, or similar type of device, 132 associated with the access cover 84. The access cover sensor 132 is configured to generate signals indicating whether the access cover is open or closed, for example. In embodiments, the access cover sensor 132 may be configured to indicate when the access cover changes position, i.e., partially open or partially closed, or indicate when an operator attempts to open the cover. The load finished signal generator generates a load finished signal that is output to the controller to indicate when ink stick insertion has been completed.

Referring again to FIG. 6, when the load request has been granted and the push block 108 has been retracted to enable ink stick insertion, the controller 70 waits to receive the load finished signal from the load finished signal generator (block 620). In response to the load finished signal, the controller is configured to output the load signal to the actuator 124 (block 624) which causes the actuator 124 to move the yoke 118 to its forward position J thus moving the push block 108 into contact with the ink column in the feed channel to apply the urging force to the column in the feed direction F. In embodiments, the sensor 130 may be configured to generate the signal after the access cover is moved from the open position to a point within a range that may be partially toward or near the closed position, at which point the actuator 124 begins moving the yoke to its forward position J which completes the closing of the access cover. Alternatively, the sensor 130 may be configured to generate the load finished signal when the access cover is moved to the fully closed position. Position of the access cover related to phasing of the load finished signal may be influenced by an objective to prevent access to moving mechanisms. In some embodiments, the load finished signal generator may comprise a user input option via the user interface 78 indicating that ink stick loading has been completed at which point the controller outputs the load signal to the actuator 124.

In addition to access control, the use of a power driven yoke positioning system enables an intermediate state in which the push block applies reduced or no force against ink sticks. This intermediate state may be implemented by the controller 70 in any suitable manner. For example, the controller may be configured to output a force reduction signal to the actuator 124 which causes the actuator to move the yoke to a position relieving force of the push block against the ink. The movement of the yoke to a point nearer the push block's retracted position relieves the urging force imparted to the push block by the spring 114. This is possible because the force of the constant force spring does exhibit a reduced force nearer its wound up state, partially due to the force vector to its attachment to the drive member. Retraction movement of the drive member may cause loss of contact between the push block and the ink sticks but the point at which this occurs will most likely be different for each of the color feed channels since ink by color is not consumed at the same rate. With the yoke in the retracted or partially retracted position, the force exerted against the ink sticks by the push block through the spring is thus relieved, which can be a reduced force, elimination of force or a combination across the group of color feed channels. A partially retracted position may enable imaging device operation equivalent to the fully forward position. As mentioned, the reduction in force results in less heat and pressure induced ink deformation and irregular path melt and flow tendencies which can cause or contribute to ink jams. The force reduction state of the push block may be activated at any suitable time, such as in a non-active ready state in which no jobs are currently being executed but the likelihood of a print job being requested is high.

The yoke positioning system may also be used to adjust the insertion openings for use with different ink stick configurations. As mentioned above, the push block may implement an insertion keying function by positioning the push block so that it protrudes into the insertion region. Automating the position of the yoke enables the yoke to be moved to a plurality of different rearward positions thus moving the push block to a plurality of different retracted positions with respect to the insertion region of the feed channel. Each retracted position may result in the push block protruding into the insertion regions at different distances thereby altering the perimeter shape of the insertion opening for each retracted position. Thus, each retracted position of the push block may correspond to a different ink stick configuration.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. A solid ink loading system for a phase change ink imaging device, the system comprising:

an ink loader of an imaging device, the ink loader including at least one feed channel having a first end, a second end, and a longitudinal chute extending between the first end and the second end, the longitudinal chute defining a feed direction from the first end toward the second end, an insertion opening through which ink sticks are inserted into the feed channel;

an access structure that provides access to the insertion opening;

a push block movably supported in the at least one feed channel for translational movement between the first end and the second end of the feed channel;

a drive member operatively connected to the push block and configured to move the push block between the first end and the second end;

an actuator operatively connected to the drive member, the actuator being configured to actuate the drive member to move the push block toward the first end of the feed channel to at least one retracted position in response to a first signal, and to actuate the drive member to move the push block to an urging position for applying an urging force to ink sticks in the feed channel in the feed direction in response to a second signal;

a load request signal generator configured to generate a load request signal; and a controller operatively connected to the actuator and the load request signal generator, the controller being configured to determine an operating state of the imaging device in response to the load request signal and to generate the first signal selectively with reference to the operating state.

2. The system of claim 1, further comprising:

the access structure operatively connected to enable insertion opening access, the access structure being configured to move between an open position in which ink stick insertion through the insertion opening is enabled and a closed position in which ink stick insertion through the insertion opening is disabled; and a locking member operatively connected to the access structure and configured to prevent movement of the access structure to the open position when the push block drive member is in an imaging device operation enabled position.

3. The system of claim 2, the locking member further including an actuator for moving the locking member between a locked position in which the access structure is prevented from moving to the open position and an unlocked position in which movement of the access structure to the open position is enabled, the controller being operatively connected to the actuator to move the locking member to the locked unlocked position selectively based on a position of the push block drive member.

4. The system of claim 2, further comprising:

a load finished signal generator configured to generate a load finished signal in response to the access structure being moved from the open position, the controller being operatively connected to the load finished signal generator and configured to generate the second signal subsequent to the load finished signal.

5. The system of claim 4, the load finished signal generator comprising a sensor associated with the access structure.

6. The system of claim 5, the controller being operatively connected to the sensor and configured to generate the second signal in response to the load finished signal.

7. The system of claim 1, the load request signal generator including a manual actuator and an electrical signal generator.

8. The system of claim 1, the load request signal generator including a user interface having a display and a user input device.

9. The system of claim 1, the controller being configured to generate the first signal in response to the operating state corresponding to a predetermined state.

10. The system of claim 1, the actuator being configured to actuate the drive member to move the push block to at least a first retracted position relative to the insertion opening and a second retracted position relative to the insertion opening, the first retracted position of the push block being configured to enable insertion of ink sticks of a first ink stick configuration and the second retracted position of the push block being configured to enable insertion of ink sticks of a second ink stick configuration while preventing insertion of ink sticks of the first ink stick configuration.

11. The system of claim 10, wherein the first retracted position is further from the second end of the feed channel than the second retracted position.

12. The system of claim 1, the controller being configured to output a third signal to the actuator, the actuator being configured to move the yoke to an intermediate position at which the push block relieves force against ink sticks in the feed channel.

13. An imaging device comprising:

at least one printhead configured to eject drops of melted phase change ink onto an ink receiving surface;

a solid ink loading system for receiving solid phase change ink sticks and melting the ink sticks to a melted phase change ink for the at least one printhead, the solid ink loading system including:

an ink loader of an imaging device, the ink loader including at least one feed channel having a first end, a second end, and a longitudinal chute extending between the first end and the second end, the longitudinal chute defining a feed direction from the first end toward the second end, an insertion opening through which ink sticks are inserted into the feed channel;

an access structure that provides access to the insertion opening;

a push block movably supported in the at least one feed channel for translational movement between the first end and the second end of the feed channel;

a drive member operatively connected to the push block and configured to move the push block between the first end and the second end;

an actuator operatively connected to the drive member, the actuator being configured to actuate the drive member to move the push block toward the first end of the feed channel to at least one retracted position in response to a first signal, and to actuate the drive member to move the push block to an urging position for applying an urging force to ink sticks in the feed channel in the feed direction in response to a second signal;

a load request signal generator configured to generate a load request signal; and a controller operatively connected to the actuator and the load request signal generator, the controller being configured to determine an operating state of the imaging device in response to the load request signal and to generate the first signal selectively with reference to the operating state.

14. The device of claim 13, further comprising:

the access structure operatively connected to enable the insertion opening access, the access structure being configured to move between an open position in which ink stick insertion through the insertion opening is enabled and a closed position in which ink stick insertion through the insertion opening is disabled; and a locking member operatively connected to the access structure and configured to prevent movement of the access structure to the open position when the push block drive member is in an imaging device operation enabled position.

15. The device of claim 14, the locking member further including an actuator for moving the locking member between a locked position in which the access structure is prevented from moving to the open position and an unlocked position in which movement of the access structure to the open position is enabled, the controller being operatively connected to the actuator to move the locking member to the locked unlocked position selectively based on a position of the push block drive member.

16. The device of claim 13, the load request signal generator including a manual actuator and an electrical signal generator.

17. The device of claim 13, the load request signal generator including a user interface having a display and a user input device.

18. The device of claim 13, the controller being configured to generate the first signal in response to the operating state corresponding to a predetermined state.

19. The device of claim 13, the controller being configured to interrupt a print job currently being executed in response to receiving the load request signal prior to the print job being completed to place the device in the predetermined state, and to generate the first signal in response to the device reaching the predetermined state.

20. The device of claim 19, the controller being configured to interrupt the print job after a page of the print job has been printed and prior to a subsequent page being printed.

* * * * *